United States Patent [19]

Hough et al.

[11] 4,255,194

[45] Mar. 10, 1981

[54] PALLADIUM ALLOY BATHS FOR THE ELECTROLESS DEPOSITION

[75] Inventors: William V. Hough, Butler; John L. Little, Evans City; Kevin E. Warheit, Butler, all of Pa.

[73] Assignee: Mine Safety Appliances Company, Pittsburgh, Pa.

[21] Appl. No.: 3,351

[22] Filed: Jan. 15, 1979

[51] Int. Cl.[3] ..... C23C 3/02

[52] U.S. Cl. ..... 106/1.24; 106/1.28; 427/437; 427/443.1

[58] Field of Search ..... 100/1.15, 1.21, 1.24, 100/1.28; 427/430 A, 437, 443.1

[56] References Cited

U.S. PATENT DOCUMENTS

| | | | |
|---|---|---|---|
| 2,915,406 | 12/1959 | Rhoda et al. | 106/1.24 |
| 3,274,022 | 9/1966 | Rhoda | 106/1.24 |
| 3,418,143 | 12/1968 | Sergienko | 106/1.28 |
| 3,754,939 | 8/1973 | Pearlstein et al. | 106/1.22 |
| 3,814,696 | 6/1974 | Verdone et al. | 106/1.15 |
| 4,004,051 | 1/1977 | Kadison et al. | 106/1.11 |

FOREIGN PATENT DOCUMENTS

| | | |
|---|---|---|
| 861703 | 2/1961 | United Kingdom . |
| 1299102 | 12/1972 | United Kingdom . |

*Primary Examiner*—Lorenzo B. Hayes

[57] ABSTRACT

A bath for the electroless deposition of palladium comprises an aqueous solution of divalent palladium, ammonia or amine, and a tertiary amine borane. The bath may contain thio-organic, iminonitrile or other stabilizers. A hard palladium alloy is plated, having the composition of 1–3% amorphous borone, 1–3% crystalline $PdH_{0.706}$, the remainder amorphous palladium. A strong laminate is formed when the alloy is plated on electroless nickel.

18 Claims, No Drawings

PALLADIUM ALLOY BATHS FOR THE ELECTROLESS DEPOSITION

BACKGROUND OF THE INVENTION

This invention relates to the electroless deposition of palladium, including alloys of palladium.

Electroless deposition is a process in which a metal is deposited on a catalytic surface by autocatalytic chemical reduction from a solution containing metal ions and a reducing agent. Electroless deposition of palladium has been described using hydrazine as a reducing agent (U.S. Pat. No. 2,915,406), unsymmetrical dimethylhydrazine (U.S. Pat. No. 3,274,022) and hypophosphite ion (U.S. Pat. Nos. 3,418,143 and 3,754,939). However, these baths have not found commercial acceptance as they are apparently not sufficiently stable for practical plating operations.

SUMMARY OF THE INVENTION

It is an object of this invention to provide an improved bath for the electroless deposition of palladium. Another object is to provide a palladium alloy plate having exceptional hardness. Another object is to provide an improved laminated plate in which a laminae of the hard palladium alloy plate is securely adhered to a laminae of electroless nickel plate. Other objects will be apparent from the following description and claims.

The baths of this invention are stable aqueous solutions containing from about 0.002 to 0.12 moles per liter of divalent palladium; 0.05 to 10 moles per liter of ammonia, or primary alkylamine having up to five carbon atoms, ethanolamine, ethylenediamine or N-methylated ethylenediamines; 0.005 to 0.21 moles per liter of a tertiary amine borane reducing agent; and 0 to 100 mg. per liter of a stabilizer. The baths tend to spontaneously decompose with higher concentrations of palladium and reducing agent or with lower concentrations of base. With lower concentrations of palladium and reducing agent the plating rate is impractically slow, and with higher base concentration the plate is poor and tends to flake.

Substantially any salt or complex of divalent palladium may be used as a source of divalent palladium, such as, for example, $(NH_4)_2PdCl_4$, $K_2PdCl_4$, $PdCl_2$, $PdBr_2$, $Pd(NO_3)_2$, $PdSO_4.2H_2O$, $(NH_3)_2PdCl_2$, $(NH_3)_2Pd(NO_3)_2$ and $Pd(NH_3)_4Cl_2.H_2O$. Palladium salts containing cyanide, thiocyanate or other anions poisonous to the plating process should be avoided. The preferred range of divalent palladium concentration is from 0.01 to 0.03 moles per liter to provide a favorable balance of stability and plating rate.

The bath contains ammonia or an amine to adjust the pH, stabilize the palladium compound or form a complex in situ. Ammonia is the preferred base-complexing agent and it is preferred to use about 0.3 to 1.0 moles of ammonia per liter. The ammonia may be entirely or partially replaced by amine, to the limit of the amine solubility. A pH range of from about 8 to 15 is suitable, with a pH of 10–12 preferred; at the lower pH values the baths exhibit some instability, while at a very high pH, plating rates are very slow.

Tertiary amine boranes, used as a reducing component of the bath, must be sufficiently soluble to provide an effective concentration, suitably above about 0.005 moles per liter. At concentrations of above about 0.21 moles per liter, when permitted by the amine borane solubility, the baths are relatively unstable. The preferred amine borane concentration is 0.01–0.07 moles/l, to provide a favorable balance of plating rate and bath stability. Suitable reductants include trialkylamine boranes, $R_1R_2R_3NBH_3$, where $R_1$, $R_2$ and $R_3$ are methyl or ethyl groups; straight chain methoxy substituted dimethylamine boranes, $CH_3(OCH_2CH_2)_nN(CH_3)_2BH_3$, where n is an integer from 1 to 4; and N alkyl substituted morpholine boranes,

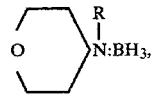

where R is an alkyl group having not more than three carbon atoms.

Plating occurs on immersion or contact of a catalytically active substrate with the bath. A smooth palladium plate results which may be black, grey or bright, and may contain minor amounts of boron or hydrogen, depending on the bath components and plating conditions. When using straight chain methoxy substituted dimethylamine boranes, the plate is spongy and can be used as a catalyst. Plating rates are as high as 12 $mg/cm^2/hr$ and are temperature dependent from about 20° C. to 70° C.

Catalytic poison stabilizers that inhibit spontaneous decomposition of the bath are preferably used at bath temperatures above 45° C., and they may also be used to advantage at lower temperatures. Suitable compounds found to stabilize the baths include thioorganic compounds, such as 2,2'-thiodiethanol or 3,3-thiodipropionitrile; mercaptans, such as 2-mercaptobenzothiazole (MBT) or 2-mercapto-1-methylimidazole; iminonitriles, such as 3,3'-iminodipropionitrile; organic cyanides, such as 4-aminobenzonitrile; salts of cadmium, mercury, lead or thallium; thioureas, such as 1,1,3,3-tetramethylthiourea; and akali metal iodates or bromates. Other electroless bath stabilizers, familiar to those skilled in the art, may be used. Only small amounts of stabilizer are needed to be effective, generally less than about 0.1 g/l. The preferred 2-mercaptobenzothiazole (MBT) and 3-3'-thiodipropionitrile give brighter plates as well as stabilize the baths.

A palladium alloy bright plate of exceptional hardness is obtained by deposition from the new plating baths, particularly from the preferred baths using $PdCl_2$ or $Pd(NH_3)_4Cl_2.H_2O$ as a metal source and trimethylamine borane as the reducing agent. The alloy contains about 1–3% amorphous boron, and about 1–3% crystalline phase $PdH_{0.706}$, with the remainder being amorphous palladium. The palladium-hydrogen compound decomposes to crystalliine palladium on heating to about 300° F. It will be recognized that the Pd-$H_2$ ratio of the crystalline palladium hydrogen intemetallic compounds may vary depending on the history of the sample. Amorphous, as used herein, designates a structurally unorganized and non-crystalline palladium or boron, insofar as crystallinity is detectable by X-ray examination using FeK$\alpha$ radiation.

The palladium alloy plate forms an exceptionally strong bond with electroless nickel, a bond stronger than the tensile strength of the palladium plate itself. There is a large body of technology for plating electroless nickel on a wide variety of metallic and non-metallic substrates, so the palladium alloy plate can be used, by plating on an electroless nickel laminae, on any substrate that can be plated with electroless nickel. Any electroless nickel is suitable, including those plated from hypophosphite baths or amine borane baths.

The baths can be regenerated by the addition of bath components, either alone or in solution, to restore the desired bath composition. Preferred baths have been regenerated, completely replacing the consumed palladium, three times with no loss in plate quality or plating rate. These baths are stable for several days at 55° C. and stable indefinitely at 45° C. or lower. Baths have been stored at ambient temperature for about a year without noticeable decomposition.

DETAILED DESCRIPTION OF THE INVENTION

The invention is described in detail, including the now preferred embodiments thereof, in connection with the following examples.

BATH PREPARATION PROCEDURE

The peferred method of preparing the baths is to make a solution of the palladium salt and ammonia or amine, a second solution of the amine borane in water, and then to mix the solutions. Stabilizers can be added to any of the solutions. It will be recognized by those skilled in the art that baths can be prepared by a variety of procedures. In making the baths used in the following examples, the palladium salt is weighed into a beaker and distilled deionized water is added. After addition of an equal volume of concentrated ammonia solution, the mixture is stirred until solution is complete. Sometimes gentle warming of the solution is required to effect solution. The catalytic poison type stabilizer, if used, is added at this point. The solution is then diluted with water to a volume of one-half the volume of the plating bath. The amine borane reducing agent is dissolved in a volume of water equal to one-half the volume of the plating bath. The two solutions are mixed and the bath filtered through medium porosity paper (Whatman 2V) to remove cloudiness, as from dust or undissolved impurities.

SUBSTRATE PREPARATION

The method of preparation of the substrate depends on the nature of the substrate and a variety of sensitization procedures are commonly known. Electroless palladium, nickel or gold require no preparation other than degreasing, which is the inital step in the preparation of any substrate. Nickel and stainless steel can be prepared by treatment with concentrated hydrochloric acid solution to remove any oxide coating, then dipping in dilute $PdCl_2$ solution, and finally in dilute dimethylamine borane solution. Copper is first treated with dilute nitric acid and then palladium chloride solution. Glass is mechanically abraded and then treated with $SnCl_2$ solution. ABS plastic is treated with NaOH solution for ½ hour and chromic acid for ½ hour and finally dipped into $SnCl_2$ solution. Ceramic is treated with $SnCl_2$ solution. Other substrates may be plated with appropriate sensitization or the substrate may be sensitized by plating or striking with electroless nickel.

EXAMPLE 1.

A bath is made up by the above bath preparation procedure to give the following concentration of ingredients: $Pd(NH_3)_4Cl_2.H_2O$, 3.75 g/l.; $NH_3$, 0.3 mole/l; trimethylamine borane (TMAB), 3.0 g/l. The pH is about 11.4. A palladium chloride sensitized nickel substrate was immersed in the bath maintained at 50° C., with a plating load of 61.5 $cm^2/l$. A light gray, smooth, adherent plate was obtained at a plating rate of 3.6–3.8 $mg/cm^2/hr$.

EXAMPLE 2

A bath is made up as in example 1 with the following concentration of ingredients: $PdCl_2$, 4.00 g/l; $NH_3$, 0.80 mole/l; N-methylmorpholine borane, 1.00 g/l; and MBT stabilizer, 30 mg/l. The pH of the bath is about 11 and the operating temperature is 45° C. A smooth, adherent shiny plate is laid down on nickel sheet ($PdCl_2$sensitized) at about 1.0 $mg/cm^2/hr$.

EXAMPLE 3

A bath is made up as in example 1 with the following concentration of ingredients: $PdCl_2$, 4.05 g/l; $NH_3$, 0.70 mol/l; and TMAB, 2.56 g/l. The pH is about 11, the substrate copper sheet and the plating load 80 $cm^2/l$. With a bath temperature of 45° C., a plating rate of 1.1–1.3 $mg/cm^2/hr$ is observed. The plate is smooth, light gray, and shiny.

EXAMPLE 4

A bath is made up as in example 1 with the following ingredients: $PdCl_2$, 2.00 g/l; $NH_3$, 0.30 mole/l; KOH, 32 g/l; 2-methoxyethyldimethylamine borane, 3.30 g/l; and MBT, 30 mg/l. The pH is about 13.3, the substrate a pyrex glass slide ($SnCl_2$ sensitized), and the plating load 164 $cm^2/l$. Maintaining the bath temperature at 25° C. gives a plating rate of 3.1–3.3 $mg/cm^2/hr$. Chemical analysis of the black, spongy palladium plate which is readily pealed off the glass, shows that it contains 2.7–2.9% boron.

EXAMPLE 5

A bath is made up as in example 1 with the following ingredients: $PdCl_2$, 4.1 g/l; $NH_3$, 0.75 mole/l; TMAB, 2.62 g/l; and 2,2'-thiodiethanol stabilizer, 3.23 mg/l. The bath pH is about 11.6 and bath temperature of 50° C. gives a plating rate of 3.7–3.9 $mg/cm^2/hr$. A dark gray, adherent palladium plate is laid down on nickel sheet. The plating load was 91.7 $cm^2/l$.

EXAMPLE 6

A bath is made up as in example 1 with the following ingredients: $PdCl_2$, 3.0 g/l; ethylenediamine, 1.1 mole/l; trimethylamine borane, 3.0 g/l; and 3,3'-iminodipropionitrile, 6 mg/l. The bath pH is about 12.2. At 45° C. palladium was plated on nickel sheet ($PdCl_2$ sensitized) at a rate of 3.6–3.8 $mg/cm^2/hr$. The plating load was 110 $cm^2/l$.

EXAMPLE 7

A bath is made up as in example 1 with the following ingredients: $PdCl_2$, 2.00 g/l; methylamine, 0.60 mole/l; and trimethylamine borane, 2.50 g/l. At 45° C., palladium was deposited on nickel sheet ($PdCl_2$ sensitized) at a rate of 3.6–3.8 $mg/cm^2/hr$. The plating load was 90 $cm^2/l$. Bath pH is about 12.3.

EXAMPLE 8

A bath is made up as in example 1 with the following ingredients: $PdCl_2$, 2.0 g/l; n-amylamine, 0.40 mole/l; and trimethylamine borane, 2.55 g/l. The bath pH is about 12. At 45° C. palladium was plated on nickel sheet ($PdCl_2$ sensitized) at a rate of 3.5–3.7 mg/cm$^2$/hr. The plating load was 73.8 cm$^2$/l.

EXAMPLE 9

A bath is made up as in example 1 with the following ingredients: $PdCl_2$, 2.00 g/l; triethylamine borane, saturated solution (about 1 g/l); and $NH_3$, 0.65 mole/l. The pH is about 11.5. Under a plating load of 79 cm$^2$/l, a plating rate of 2.3–2.5 mg/cm$^2$/hr was observed on nickel sheet. The plate was dark gray and very adherent.

EXAMPLE 10

A bath is made up as in example 1 with the following ingredients: $PdCl_2$, 4.00 g/l; $NH_3$, 0.6 mole/l; trimethylamine borane, 2.50 g/l; and MBT, 3.5 mg/l. With a bath temperature of 45° C., a plating rate on electroless nickel-phosphorous of 1.8–2.0 mg/cm$^2$/hr was observed. The electroless nickel was plated on nickel sheet which had been electrocleaned and electropolished.

Samples generated using baths of Example 10 were tested and analyzed to determine the composition and physical properties of the electroless plate.

Microhardness measurements were made with a 25 g. load on an electroless palladium alloy plate at least 0.5 mil thick on electroless nickel, which was deposited from a hypophosphite bath on a nickel substrate. The palladium alloy was plated from the plating bath of Example 10. The hardness of the fresh palladium alloy was 718 Knoop. A similar plate on a $PdCl_2$-sensitized nickel substrate, aged for three months, was 764 Knoop. The hardness of the aged sample was not appreciably changed by heating to 356° F. for 16 hours. The plated alloys having a Knoop hardness of above about 700 are substantially harder than palladium itself, which can have a Knoop hardness of 70 to about 250. The new alloy plate is much harder than the hardest electroplated gold (300–350 Knoop) or even electroless nickel-phosphorous (500 Knoop).

Electroless palladium alloy samples deposited from baths of Example 10 were subjected to X-Ray defraction analysis using $FeK_{\alpha}^{o}$ radiation. The analysis showed a crystalline phase of $PdH_{0.706}$, with no more than traces of crystalline palladium and boron. The $PdH_{0.706}$ content of the plate alloy ranges between about 1–3% by weight, as determined by measurement of hydrogen released on heating the sample to 300° C. to decompose the $PdH_{0.706}$. The amorphous boron content of the alloy, determined by chemical analysis, ranges between 1 and 3% by weight. The remainder is amorphorus palladium.

The bond between the palladium alloy, as plated in example 10, and electroless nickel is stronger than the palladium laminae itself. A nickel tab was electroplated on the palladium alloy surface of a laminate of palladium alloy on electroless nickel on a nickel substrate. When the tab was pulled away from the lamination in a conventional peel test, 21 pounds of force was required to separate the laminations of a ½-inch wide specimen. The rupture actually occurred in the palladium and not at the bond interface. The effective bond strength of 42 pounds per inch of width is much above acceptable bond strength for decorative or electronic plating applications. The porosity of the plate depends on the smoothness of the substrate and the thickness of the plate. Substantially all pores (less than about 1 pore per/cm$^2$) were closed in a 30–40 microinch thick plate plated on an electrocleaned and electropolished electroless nickel substrate. When the electroless nickel substrate was chemically cleaned, more than 50 microinches of palladium alloy had to be plated to close the pores.

Palladium plates of the invention are useful in the manufacture of printed circuit boards, electronic switch contacts, decorative coatings and for other purposes. While the presently preferred embodiments have been described, the invention may be otherwise embodied within the scope of the appended claims.

We claim:

1. A bath for the electroless deposition of palladium comprising an aqueous solution containing:

(a) between about 0.002 and 0.12 moles per liter of divalent palladium, (b) between about 0.05 and 10 moles per liter of a base selected from ammonia, primary alkylamines having up to five carbon atoms, ethanolamine, ethylene diamine, N-methylated ethylene diamines or mixtures thereof, (c) between about 0.005–0.21 moles per liter of a reducing agent selected from the group of tertiary amine boranes consisting of trialkylamine borane having the formula $R_1R_2R_3NBH_3$, where $R_1$, $R_2$ and $R_3$ are methyl or ethyl groups; straight chain methoxy substituted dimethylamine boranes having the formula $CH_3(OCH_2CH_2)_nN(CH_3)_2BH_3$, where n is an integer from 1 to 4; and N alkyl substituted morpholine borane having the formula

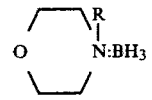

where R is an alkyl group having not more than three carbon atoms.

2. A bath according to claim 1 containing an effective amount up to about 0.1 grams per liter of a stabilizing agent selected from 2-mercaptobenzothioazole, 3,3'-iminiodipropionitrile, 3,3'-thiodipropionitrile, 2,2'-thiodiethanol, and alkali metal iodates or bromates.

3. A bath according to claim 1 in which divalent palladium is present as palladium chloride or an ammonia complex thereof and the base is ammonia.

4. A bath according to claim 1 in which the amine borane is of the formula $R_1R_2R_3NBH_3$, where $R_1$, $R_2$ and $R_3$ are methyl or ethyl groups.

5. A bath according to claim 1 in which the amine is trimethylamine borane.

6. A bath according to claim 5 in which divalent palladium is present as palladium chloride or an ammonia complex thereof, and the base is ammonia.

7. A bath according to claim 2 in which the amine is trimethylamine borane.

8. A bath according to claim 7 in which the divalent palladium is present as palladium chloride or an ammonia complex thereof, and the base is ammonia.

9. A bath according to claim 8 in which the stabilizer is 2-mercaptobenzothiazole.

10. A bath according to claim 1 containing between about 0.01 to 0.03 moles per liter of divalent palladium.

11. A bath according to claim 1 containing between about 0.3 to 1 mole per liter of ammonia.

12. A bath according to claim 1 containing between about 0.01 to 0.07 moles per liter of amine borane.

13. A bath according to claim 10 in which the divalent palladium is present as palladium chloride or ammonia complex therof, and the base is ammonia present in a concentration between about 0.3 to 1.0 moles per liter.

14. A bath according to claim 13 containing trimethyl amine borane in a concentration between about 0.01 to 0.07 moles per liter.

15. A bath according to claim 14 continuing the stabilizer 2-mercaptobenzothiazole.

16. A bath for the electroless deposition of palladium comprising an aqueous solution containing about 4 grams per liter of $PdCl_2$, 0.6 mol per liter of ammonia, 2.5 grams per liter of trimethylamine borane and 3.5 milligrams per liter of 2-mercaptobenzothiazole.

17. A bath according to claim 1 in which the amine borane is of the formula $CH_3(OCH_2CH_2)_nN(CH_3)_2BH_3$, where n is an integer from 1 to 4.

18. A bath according to claim 1 in which the amine borane is of the formula

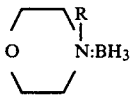

where R is an alkyl group having not more than 3 carbon atoms.

* * * * *